US006079567A

United States Patent [19]

Gray

[11] Patent Number: 6,079,567

[45] Date of Patent: Jun. 27, 2000

[54] SEPARATOR FOR SEPARATING PARTICLES FROM A SLURRY

[76] Inventor: Alexander Hamilton Gray, 2 Faraday Street, Avoca, VIC 3476, Australia

[21] Appl. No.: 08/702,470

[22] PCT Filed: Mar. 15, 1995

[86] PCT No.: PCT/AU95/00137

§ 371 Date: Jul. 15, 1998

§ 102(e) Date: Jul. 15, 1998

[87] PCT Pub. No.: WO95/26232

PCT Pub. Date: Oct. 5, 1995

[30] Foreign Application Priority Data

Mar. 25, 1994 [AU] Australia ..... PM4739

[51] Int. Cl.[7] ..... B03B 7/00; B03B 5/00; B07B 9/00; B07B 4/00

[52] U.S. Cl. ..... 209/44; 209/423; 210/808; 210/280

[58] Field of Search ..... 209/13, 44, 423, 209/424, 425, 426, 454, 456, 467; 210/519, 480, 785, 780, 792, 807, 808, 268, 289, 793, 388, 379, 383, 416.1, 280, 433.1, 539, 786

[56] References Cited

U.S. PATENT DOCUMENTS

| | | | |
|---|---|---|---|
| 2,132,377 | 10/1938 | Bird et al. | 209/500 |
| 2,134,154 | 10/1938 | Smith | 209/425 |
| 3,703,237 | 11/1972 | Cohen-Alloro et al. | 209/426 |
| 5,453,179 | 9/1995 | Stultz | 210/97 |

FOREIGN PATENT DOCUMENTS

| | | |
|---|---|---|
| 280520 | 1/1968 | Australia . |
| 2100162 | 7/1971 | Germany . |
| 2469957 | 5/1981 | Germany . |
| 3126698 | 4/1983 | Germany . |
| 535931 | 4/1941 | United Kingdom . |

*Primary Examiner*—Matthew O. Savage
*Assistant Examiner*—Richard W. Ward
*Attorney, Agent, or Firm*—Nixon & Vanderhye P.C.

[57] ABSTRACT

A separator (1) for separating dense particulates from slurry includes a sealed housing (2) enclosing a submerged screen bed (33) which allows dense particulates to fall into a hutch (6) from which they may be discharged. The housing has a slurry inlet (4) arranged to deliver slurry to a sump (3) which directs slurry to flow radially over the bed. An annular cavity (23) formed between the housing and bed receives tailings flowing off of the top of the bed. An outlet (7) from the annular cavity allows discharge of the tailings, and a liquid inlet (30) to the hutch provides an upward flow of liquid through the bed. The bed is agitated to assist passage of dense particulates.

15 Claims, 2 Drawing Sheets

SEPARATOR FOR SEPARATING PARTICLES FROM A SLURRY

TECHNICAL FIELD

The present invention relates to a separator for separating particles from a liquid. More particularly, the invention relates to a jig for separating metal values from a liquid slurry.

The present invention may be advantageously applied to jigs for separating metal values from gangue. It is convenient to hereinafter describe the invention in relation to that particular embodiment, however it is to be appreciated that the invention described herein may also be advantageously applied to other types of separating apparatus.

BACKGROUND ART

Jigs are one of the most common separators used in the known process for separating heavy minerals or ores from lighter gangue. The "Harz Jig" is one of the older types of jigs and includes a submerged fixed screen through which water is pulsed as the ore and gangue moves across the screen, causing the lighter gangue to flow along the surface of the water over the screen and the heavier ores to gravitate down and through the screen. The "Hancock Jig" utilizes an oscillating screen in a tank of water whereby a tray is given a combined horizontal and vertical reciprocating motion which causes the ore and gangue to pass rapidly over the screens, with the lighter gangue moving over the screen and the heavier material passing through the screen.

Previously, jigs were used widely for concentrating and washing base metal ores. Jigs are simple in operation and can be constructed locally with low cost to the owner and little maintenance. The use of jigs today, however, is slowly diminishing due primarily to the fact that power and water consumptions are high in known jigs and the tailing losses are generally higher than in other separating processes.

DISCLOSURE OF INVENTION

The present invention provides in one preferred embodiment a separator for separating dense particulates from a slurry said separator including:

- a housing for holding liquid;
- a bed for retaining larger particles from the slurry said bed being arranged to be submerged in the liquid;
- a slurry inlet for introducing slurry into the separator to flow across the top of the bed;
- liquid supply means arranged to direct a current of liquid to pass through the bottom of the bed to the top of the bed;
- agitation means for facilitating passage of fine particles through the bed;
- a hutch for receiving dense particulates passing through the bed; and
- a tailings outlet for removal of tailings flowing from said bed.

According to a further embodiment the invention also provides a method of separating dense particulates from a slurry including the steps of:

- causing the slurry to flow over a bed submerged in liquid, the bed being adapted to retain larger particles from the slurry; and
- flowing water upwardly through the bed at such a rate as to allow small dense particulates to fall through the bed whilst at the same time causing a mixture of gangue and liquid to flow over the top of the bed to be discharges as tailings.

In one arrangement the agitation means comprises means for oscillating the bed by moving the bed in a generally up and down direction the stroke preferably being in excess of, at least 60% of the largest dimension of at least 90% of the heavy particulates.

In a particularly preferred arrangement according to the present invention the housing is substantially the same shape as the hutch thereby forming a chamber between the hutch and the housing. The chamber may be annular. Preferably the chamber is shaped to facilitate movement of liquid which flows over the outer edge of the bed into the chamber during use of a separator according to the present invention.

The housing provided according to the present invention may completely surround the hutch. In a preferred arrangement the housing substantially surrounds the hutch. In a particularly preferred embodiment the housing comprises an upper component and a lower component. The upper component is preferably substantially cylindrical. The lower component may be funnel shaped and is preferably substantially conical in shape. Most preferably the funnel shaped lower component is substantially frustoconical in shape. The upper and lower components may be connected to one another. The upper and lower components may be removably connected to one another. In a preferred arrangement the upper and lower components of the housing are rigidly connected to one another.

The housing may be substantially enclosed. Preferably the housing is suitable to be pressurized. A pressurized housing allows the separator to be operated at greater than atmospheric pressure. Pressure greater than atmospheric pressure in a pressurized housing can be reached by increasing the volume of liquid in the hutch whereby to decrease the volume of air in the housing which increases the pressure. Alternatively a pressure greater than atmospheric pressure may be achieved by injecting additional air into the housing by an injecting means while retaining the same volume of liquid. In a particular arrangement in accordance with the present invention the volume of liquid may completely fill the hutch and may partially fill the housing to the extent that a gap between the level of the liquid and the top of the housing is present. The gap may be filled with air. The width of the gap depends on the level of the liquid in the housing and may be regulated by the flow of liquid into the hutch or by the injection of air into the housing. The width of the gap may be adjusted to bring about corresponding adjustment to the rate of flow of liquid across the bed. More specifically, narrowing the gap decreases the flow of the liquid across the bed and widening the gap increases the flow of liquid across the bed. In yet another arrangement in accordance with the present invention the housing may be filled with liquid and the liquid placed under pressure by the pressure of at least one inlet being at greater than atmospheric pressure.

The housing may include access means. The access means may be in the form of a removable top, removable access hatch or other form known in the art. The access means preferably facilitates access to the interior of the housing. Such access may be required for example for maintenance and/or for emptying particles trapped in the bed. Preferably the access means facilitates the removal of the bed or a portion thereof from the housing.

The housing may contain means for supporting or suspending the separator. The supporting means may take the form of one or more flanges, lugs or other components adapted for connection to a frame, gantry or other construction for supporting the separator.

The hutch provided by the present invention may be adapted to concentrate dense particulates such as metal values which enter the hutch. Gold is a preferred example of metal values. The hutch may include one or more angled surfaces for directing metal values sinking within the hutch toward one or more collection points. The hutch may include a funnel shaped component for directing sinking metal values within the hutch toward or through an outlet at or adjacent the funnel apex. More preferably the hutch includes an upper component and a funnel shaped lower component. The upper component may be substantially cylindrical in shape and the lower component may be substantially conical in shape. Preferably the lower component of the hutch is substantially frustoconical and arranged in use in an inverted orientation. When the lower component has such an arrangement the base of the frustocone may be connected to the upper component. The walls of the frustocone may, in this arrangement, taper inwardly toward the lowermost point. Metal values sinking within the hutch tend to gravitate toward the lowermost point which thereby forms a collection point for metal values within the hutch.

The apex of the frustocone which is the lowermost point in use in an inverted configuration may be dosed off with a seal. The seal may be of flexible material. Preferably the seal is a flexible diaphragm such as a rubber diaphragm. More preferably the rubber diaphragm is annular and substantially surrounds a drive shaft of the oscillating means. The seal may be removable from the housing for maintenance purposes and/or recovery of metal values.

The lower component and upper component of a hutch according to the present invention are preferably connected. The components may be connected by a flexible connecting means. In a preferred embodiment the upper and lower components are independently supported within the housing. The connecting means may be a diaphragm, preferably a flexible diaphragm. A rubber diaphragm has been found to be particularly suitable for use in accordance with the present invention. The connecting means may act to resist metal values within the hutch from escaping therefrom. More preferably, the connection allows relative movement of the upper component and lower component. In a particularly preferred arrangement the lower component is fixed allowing substantially vertical movement of the upper component relative thereto.

The present invention may also include pressure regulating means. The pressure regulating means preferably controls the level and/or pressure of liquid in the hutch. The liquid in the hutch may be aqueous. In another arrangement the pressure regulating means may allow for the insertion of air into the housing. The pressure regulating means may be located in the housing. Preferably the pressure regulating means is located in the hutch. More preferably the pressure regulating means contains a liquid inlet to allow liquid to be inserted into the hutch. In another arrangement the liquid inlet contains means to allow liquid to be either inserted into the hutch or removed from the hutch whereby to regulate the air pressure in the housing.

In a particularly preferred arrangement in accordance with the present invention the pressure regulating means includes a liquid inlet adapted to regulate the flow of liquid into the hutch.

A concentrate outlet may also be provided in accordance with the present invention. The concentrate outlet may be provided in the hutch. The concentrate outlet may facilitate the discharge of a concentrate containing metal values.

The concentrate outlet may comprise a flanged conduit extending outwardly from the hutch. The flanged conduit may be connectable to a concentrate discharge pipe for conveying concentrated metal values discharged from the separator provided in accordance with the present invention.

The concentrate outlet may be substantially similar to the pressure regulating means liquid inlet. Preferably the concentrate outlet extends from the hutch adjacent the lowermost point thereof.

The present invention also provides for a slurry inlet for introducing a slurry into the sump to flow across the top of the bed. The slurry inlet may be in the form of a pipe or other conduit. The slurry inlet may project through the housing preferably at or adjacent the top of the housing. The downstream end of the slurry inlet may project into a sump. The slurry inlet may be substantially tubular. Preferably the inlet forms an elbow to facilitate the movement of the slurry to the sump. More preferably the inlet is a flanged substantially tubular elbow. In a particularly preferred arrangement the inlet is a flanged substantially tubular elbow of 150 mm diameter.

The sump provided in accordance with the present invention is preferably substantially cylindrical. Such an arrangement may, in use, produce a substantially horizontal flow of slurry from the sump. Preferably the base of the sump is flat. The sump may be located outside the hutch. The sump may be located at the top of the hutch. Preferably the sump is located in the hutch. In one preferred arrangement the sump is located in the hutch near the top of the hutch. In this arrangement the sump is preferably centrally located in the hutch.

In a particularly preferred arrangement the sump is in the form of an open top drum. The slurry inlet preferably projects into the open top of the drum in this arrangement whereby slurry is introduced into the sump below the liquid level and exits by flowing radially outwardly over the upper edges of the open top.

The sump may thereby produce a substantially horizontal flow of slurry as it flows over the edge of the sump.

Whilst the foregoing arrangement describes the use of a sump to direct slurry flow from the slurry inlet across the bed it is to be understood that alternative approaches may also be desirable. Thus, for example, the slurry inlet may be provided with an inverted conical distributor arranged to divert the slurry evenly across the bed in all directions.

The bed provided in accordance with the present invention may be located outside the hutch. Preferably the bed is located at the top of the hutch. Most preferably the bed is located in the hutch. In a preferred arrangement the bed is located in the hutch near the top of the hutch. The bed is preferably substantially circular in plan view.

The bed provided by the present invention preferably lies adjacent the sump. The bed may completely surround the sump. Preferably the top of the bed and the top of the sump are substantially planar. The depth of the bed in this arrangement may be less than the depth of the sump. In another embodiment the depth of the bed may be greater than the depth of the sump. In this arrangement the bed may completely surround the sump except for the open top of the sump.

In a preferred embodiment the bed is annular and substantially surrounds the sump. The bed may be attached to the sump or adjacent thereto. Preferably the radial flow of the slurry from the sump flows onto the bed. The surface area of the bed may be substantially greater than that of the sump. Thereby the speed of the flow of slurry decreases as it passes across the bed. The speed of flow of the slurry over the bed can also be decreased by increasing the depth of slurry flowing over the top of the bed. This in effect corresponds to the depth of immersion of the bed in the liquid in the separator. Preferably the depth is in excess of 50 mm. The result of the reduction in the speed of flow as the slurry stream passes across the bed is that the heavier particles tend to be deposited by the stream onto the bed. Such heavier particles typically include metal values. Lighter particles may be retained in slurry form despite the lower speed and may flow from the bed as a tailings stream.

The bed may be divided into segments. The segments may be divided by partitions. Preferably the partitions are at radial intervals from the sump. The partitions may be spaced at regular intervals. More preferably the partition intervals are increased the further the distance across the bed from the sump. In a particularly preferred arrangement the bed is in use submerged in the liquid contained in the hutch, thereby creating a floatation bed.

The bed may include a screen. Preferably the screen is located at the base of the bed. More preferably the screen comprises the base of the bed. The screen may be of a type known in the an for separating larger particles from smaller particles. Larger particles, ie. those too large to pass through the apertures of the screen being used, are retained on the screen whereas smaller particles may pass through the screen. The screen may be in direct communication with the interior of the hutch. Metal values comprising smaller particles deposited on the bed may accordingly move down into the lower component of the hutch on passing through the screen.

The size and shape of the apertures in the screen may be varied in accordance with variations in the feed as will be appreciated by those skilled in the art. The feed is preferable of a size range suitable to be conveyed as a slurry.

A wire mesh screen with apertures between 1 to 4 mm in maximum dimension has been found particularly suitable for use in accordance with the present invention. Most preferably the apertures in the screen are about 2 mm in maximum dimension. In a particularly preferred arrangement the size of the apertures in the screen allows a majority of the metal values in the feed to pass through the screen into the lower component of the hutch and prevents larger particles of gangue with a relative density greater than the liquid in the hutch from passing through the screen. Preferably the screen will pass at 90% of the weight of dense particulates.

The bed may optionally include aggregate which is built up over time by the slurry or the aggregate may be specifically placed on the sheet or mesh to facilitate the process of separating the dense particulates. It has been found that choosing aggregates having a specific gravity less than that of the dense particulates being separated but higher than that of the particulates in the tailings may improve the effectiveness of the separator. Typically the aggregates will be present in the bed to a depth in excess of 50 mm more preferably 100 mm.

As with all such screening arrangements there is a tendency for smaller particles deposited on the bed to become entrapped by larger particles and hence not pass through the screen.

The separator provided by the present invention accordingly may include oscillating means to agitate the bed and thereby facilitate percolation of smaller particles through the larger particles trapped by the screen, and through the screen into the lower component of the hutch.

The oscillating means may provide a lateral component of movement. Preferably the oscillating means provides a reciprocating motion of movement. More preferably the oscillating means imparts a substantially vertical movement to the bed. In a particularly preferred arrangement the oscillating means imparts substantially vertical movement to oscillate the bed and facilitate the gravitation of heavy metal values through the bed and screen.

The oscillating means may cause the sump to oscillate which in turn causes the bed to oscillate. The oscillating means may cause the bed to oscillate without oscillating the sump. Preferably the bed is connected to the sump and the oscillating means oscillates the bed and the sump in unison.

The oscillating means may include a ram. Preferably the oscillating means comprises a hydraulic ram. The hydraulic ram may have a stroke variation. The distance travelled by the ram should be equal to at least 60% of the largest dimension of at least 90% of the dense particulates by weight. Typically this distance will be in excess of 15 mm and preferably between 15 to 35 mm. Preferably the distance travelled by the ram is about 25 mm. The stroke frequency of the ram may be between 20 to 500 cycles per minute. Preferably the stroke speed of the ram is between 50 and 300 cycles per minute.

The ram may include or be connected to a shaft. The shaft may extend into the hutch. The shaft may be affixed to the upper component of the hutch. The shaft may directly support the sump. A plurality of supports may extend from the shaft to the upper component of the hutch. The supports may be circumferentially spaced about the hutch. The supports may each be in the form of a strut.

A separator according to the present invention also includes an outlet for discharging tailings. The outlet may be located in the housing and is preferably situated near the bottom of the housing. In a particularly preferred arrangement the housing incorporates an outlet for the tailings contained in the liquid stream that overflows the bed into the chamber between the housing and the hutch. The outlet may comprise a discharge tube. The outlet may be flanged or otherwise adapted for connection to piping or other conduits for conveying the discharged tailings stream from the separator.

The length and orientation of the discharge pipe extending beyond the tailings outlet of a separator according to the present invention may affect the required inlet pressure for operation of a jig according to the present invention. As those skilled in the art will appreciate if the discharge pipe extends above the level of the tailings outlet at any stage the pressure head created will need to be overcome for tailings to be discharged from the separator.

BRIEF DESCRIPTION OF DRAWINGS

To further assist in the understanding of the present invention, particularly preferred embodiments of the invention will now be described in relation to the accompanying drawings.

In the drawings.

Figure 1:
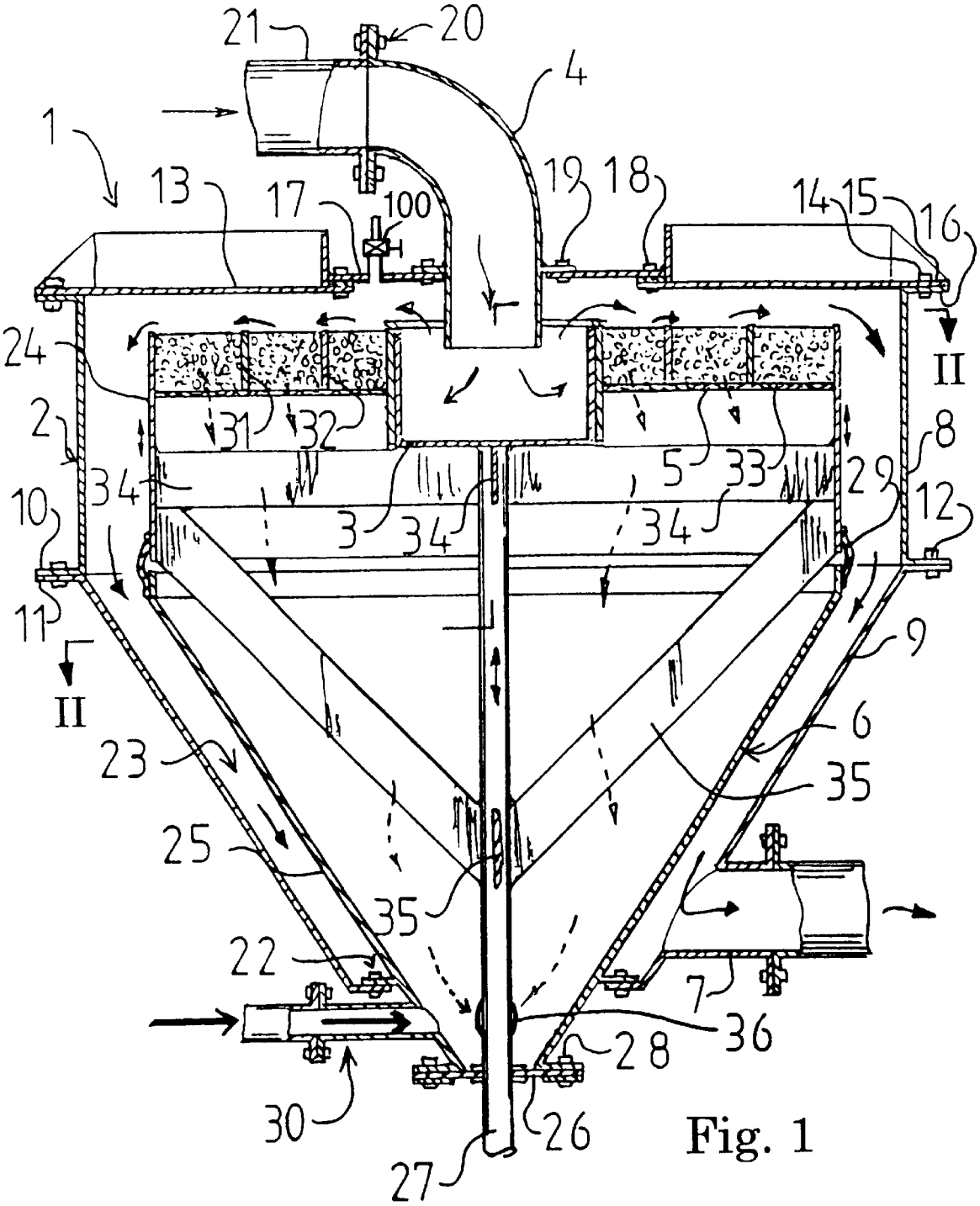
FIG. 1 is a cross-sectional view of a separator according to one preferred embodiment of the present invention.

The separator 1 includes a housing 2. The housing 2 contains a sump 3 for receiving a slurry via slurry inlet 4. Housing 1 also contains a bed 5 and a hutch 6. A discharge outlet 7 is provided for discharging tailings from housing 2.

Housing 2 comprises upper component 8 and lower component 9. Upper component 8 is substantially cylindrical and lower component 9 is funnel shaped. In the embodiment illustrated, the funnel shaped lower component 9 is arranged in the form of an inverted frustocone. Upper component 8 and lower component 9 of housing 2 are connected to one another by outwardly extending flanges 10 and 11 respectively which are secured to one another such as by bolts 12 or other known securement means.

Housing 2 includes access means in the form of a removable top 13. Top 13 is secured by bolts 14 or other securement means which pass through apertured flanges or lugs 15 and 16 in top 13 and upper component 8 respectively. In addition, a removable access hatch 17 is provided in top 13. Access hatch 17 is similarly affixed to top 13 via bolts 18 or other securement means and to inlet 4 via bolts 19 or other securement means.

Inlet 4 may be removably connected via connection means 20 to delivery pipe 21 which, in the embodiment illustrated, represents the means for delivery of slurry to inlet 4.

As will be appreciated by those skilled in the art, access to sump 3 and bed 5 can be achieved either by removing top 13 completely or by removing inlet 4 and access hatch 17 via bolts 18, 19 and 20.

In the embodiment illustrated, housing 2 substantially surrounds hutch 6. Hutch 6 is mounted on housing 2 via mounting means 22. Hutch 6 is substantially the same shape as housing 2 so that a substantially annular chamber 23 is formed therebetween.

Hutch 6 includes an upper component 24 and a lower component 25. Upper component 24 is substantially cylindrical and lower component 25 is funnel shaped. The walls of funnel shaped lower component 25 taper inwardly, thereby providing an angled surface for directing metal values sinking within hutch 6 toward a collection point adjacent the funnel apex. A flexible diaphragm 26 is secured at the lowermost point of the lower portion 25 of hutch 6. Diaphragm 26 is annular and substantially surrounds drive shaft 27 which forms part of the oscillating means, the balance of which is not shown in the drawings. Diaphragm 26 may be removed for maintenance purposes and/or recovery of metal values by removal of bolts 28 or other fastening means which extend through diaphragm 26 and secure the diaphragm to the lower portion 25.

Upper component 24 and lower component 25 are connected via flexible diaphragm 29. The flexible diaphragm enables the upper component 24 to oscillate relative to the fixed lower component 25.

The pressure regulating means comprises an inlet pipe 30 which may be connected to a water source whereby to introduce additional liquid into the hutch and thereby increase the pressure applied to liquid flowing within separator 1.

Pressure regulating means 30 may be opened to enable dense particulates such as metal values within hutch 6 to be extracted in a direction contrary to that indicated by the arrows. However, more generally (as in the embodiment illustrated) a separate concentrate outlet 36 is provided. Although not clearly seen in the drawls outlet 36 comprises a flanged conduit extending outwardly from hutch 6 which is substantially similar in appearance to inlet pipe 30 but arranged at an angle of about 90° thereto. In an alternative arrangement (not shown) the outlet may be placed directly opposite inlet 30.

Slurry inlet 4 projects through top 13 of housing 2 and the downstream end thereof projects into sump 3 as is dearly seen in FIG. 1. In the embodiment illustrated the slurry inlet comprises a flanged substantially tubular elbow.

Sump 3 is located within hutch 6 near the top thereof. Sump 3 is located substantially centrally within hutch 6 and is in the form of an open top drum in the preferred embodiment illustrated.

Figure 2:
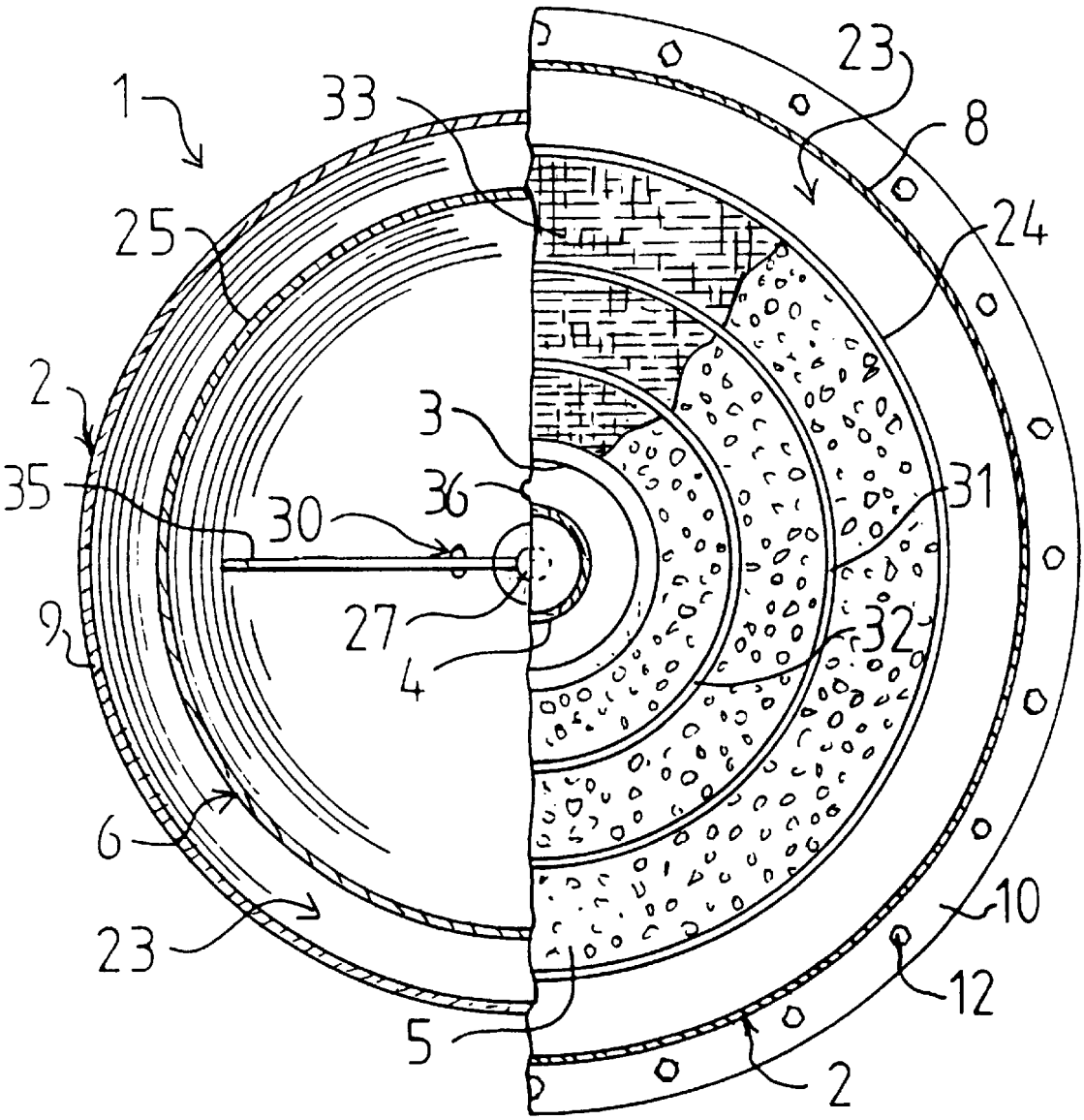
FIG. 2 is a cross-sectional view of the separator of FIG. 1 along the lines II—II.

Bed 5 is located at the top of hutch 6 and as best seen in FIG. 2, is substantially circular in plan view. In the embodiment illustrated, bed 5 completely surrounds sump 3 and the top of the bed 5 and the top of the sump 3 are substantially planar. The depth of the bed 5 is less than the depth of the sump 3 so that bed 5 is annular and substatially surrounds the sump 3. Bed 5 is divided by partitions 31, 32 spaced at radial intervals from sump 3. Bed 5 further includes a perforated screen 33 which as best seen in the partly cut-away portion of FIG. 2, is situated beneath partitions 31, 32.

In the embodiment illustrated, screen 33 comprises the base of bed 5. Screen 33 is in direct communication with the interior of hutch 6 so that particles small enough to pass through screen 33 may sink within hutch 6 toward diaphragm 26.

The oscillating means operates via shaft 27 to cause sump 3 to oscillate at the same time as bed 5. Shaft 27 is connected via beams 34 to sump 3 and also via supports in the form of struts 35 which are connected to upper component 24 at their upper extremity and shaft 27 at their lower extremity. Supports 35 are circumferentially spaced about hutch 6 and shaft 27.

BEST MODE FOR CARRYING OUT INVENTION

In use, a slurry is introduced into the sealed separator through slurry inlet 4 at a predetermined rate of flow. The slurry flows into sump 3. It is preferable if the sump 3 is substantially cylindrical so that a substantially horizontal flow of the slurry is produced in the sump. In the preferred arrangement illustrated the bed 5 is annular and surrounds the substantially cylindrical sump 3 so that the flow of slurry moves radially across the annular bed 5 in the direction of the outer edge of the annular bed as illustrated by the arrows. A liquid, preferably aqueous, is introduced into hutch 6 via regulating means 30 located adjacent the bottom of the hutch 6. Liquid is introduced into hutch 6 until the liquid completely submerges bed 5 and fills the separator. A valve 100 may be provided to completely purge air. The oscillating means, preferably a hydraulic ram drive, oscillates the bed 5 via movement of shaft 27.

As the slurry moves radially across bed 5 the rate of flow decreases so that metal values with a relative density greater than water are deposited onto bed 5 and gravitate down through the bed. The lighter particles with a lesser relative density travel across bed 5 in the direction of the outer edge of the bed 5. The metal values gravitate to screen 33 at the base of bed 5 and if of suitable size, pass through screen 33 and sink within hutch 6 to be collected at the base of the hutch 6. The lighter materials which pass over the outer edge of the bed 5 flow down chamber 23 between housing 2 and bed 5 and can be discharged via outlet 7.

The housing 2 and hutch 6 are preferably substantially filled with liquid so that the rate of flow of liquid therein can be varied by varying the rate of inflow of liquid through inlet 30. The rate of flow of liquid is preferably varied so that a substantially clear concentration is discharged from outlet 36. If the discharge from outlet 36 becomes clouded, this indicates that the flow of liquid across bed 5 is too slow, so that lighter particles are being deposited on the bed. By increasing the inflow of water through inlet 30 the speed of flow across bed 5 may be increased whereby fine particles exit as tailings via outlet 7 and a substantially clear concentrate of metal values is discharged via outlet 36.

The concentrated discharge may be treated for extracting the metal values by known techniques which may vary with the volume, metal content and other factors.

While it has been convenient to describe the invention herein in relation to particularly preferred embodiments, it is to be appreciated that other constructions and arrangements are also considered as falling within the scope of the invention. Various modifications, alterations, variations and/or additions to the constructions and arrangements described herein are also considered as falling within the ambit and scope of the present invention.

What is claimed is:

1. A separator for separating dense particulates from a slurry said separator including:

a substantially enclosed housing for holding liquid;

a bed for retaining larger particles from the slurry said bed being arranged to be submerged in the liquid;

a slurry inlet for introducing slurry into the separator to flow across the top of the bed;

liquid supply means arranged to direct a current of liquid to pass upwardly through the bed;

agitation means for agitating the bed to facilitate passage of fine particles through the bed;

a hutch having a dense particulates outlet for receiving dense particulates passing through the bed;

a tailings outlet for removal of tailings flowing from the bed; and means for maintaining greater than atmospheric pressure in an airtight sealed chamber within which the bed is located and enclosed formed between the hutch and housing, wherein the chamber is arranged to receive tailings overflowing the bed prior to removal through the tailings outlet wherein said chamber operates at superatmospheric pressure maintained throughout the chamber by the application of greater than atmospheric pressure through at least one inlet to the chamber.

2. A separator according to claim 1 including a sump arranged substantially centrally in the bed to receive slurry from the slurry inlet and to allow the slurry to flow from the sump over the bed.

3. A separator according to claim 1 wherein the agitation means include means for oscillating the bed by moving the bed in a generally up and down direction by a reciprocable shaft.

4. A separator according to claim 1 wherein the liquid supply means include a liquid inlet for delivering liquid to the hutch and the hutch is arranged to direct a flow of liquid from the liquid inlet through the bed.

5. A separator according to claim 1 wherein an annular cavity located within the chamber and arranged to receive tailings overflow from the bed is defined between the hutch and housing.

6. A separator according to claim 1 wherein the hutch includes a bottom generally conical shaped portion which is mounted on the housing wherein the dense particulates outlet is provided in said bottom hutch portion.

7. A separator according to claim 1 wherein the hutch includes an upper cylindrical portion supporting the bed and a lower conical portion, the upper and lower portions being connected by a circumferential resilient material which permits vertical reciprocation of the upper cylindrical portion with respect to the lower generally conical portion.

8. A separator according to claim 1 wherein the bed includes a generally horizontally extending screen and a layer of aggregate with an average depth exceeding 50 mm, the layer of aggregate having a specific gravity less than the specific gravity of the dense particulates but greater than the specific gravity of the particulates in the tailings.

9. A method of separating dense particulates from a slurry using a separator, wherein the separator includes a substantially enclosed housing for holding liquid; a submerged bed for retaining larger particles from the slurry; a slurry inlet for introducing slurry into the separator to flow across the top of the bed; a liquid supply arranged to direct a current of liquid to pass upwardly through the bed; an agitation means for agitating the bed to facilitate passage of fine particles through the bed; a hutch having a dense particulates outlet for receiving dense particulates passing through the bed; a tailings outlet for removal of tailings flowing from the bed; and means for maintaining greater than atmospheric pressure in an airtight sealed chamber within which the bed is located and enclosed formed between the hutch and housing, wherein the chamber is arranged to receive tailings overflowing the bed prior to removal through the tailings outlet, wherein said chamber enables operation at superatmospheric pressure maintained throughout the chamber by the application of greater than atmospheric pressure through at least one inlet to the chamber, said method including the steps of:

maintaining superatmospheric pressure throughout the airtight sealed chamber;

agitating the bed;

flowing water upwardly through the bed at such a rate as to allow small dense particulates to fall through the bed while at the same time causing a mixture of gangue and liquid to flow over the top of the bed;

collecting tailings overflowing the bed in an overflow chamber provided within the airtight sealed chamber; and discharging tailings from the overflow chamber while maintaining superatmospheric pressure throughout the airtight sealed chamber and overflow chamber.

10. A method according to claim 9 wherein the upward rate of flow of water is adjusted to maintain beneath the submerged bed liquid that is substantially clear.

11. A method according to claim 9 wherein the chamber has been purged of air.

12. A method according to claim 9 wherein the bed is reciprocated in a generally vertical direction, the length of stroke of reciprocation being equal to at least 60% of the largest dimension of at least 90% by weight of the dense particulates present in the slurry.

13. A method according to claim 9 wherein the bed is reciprocated in a generally vertical direction the length of stroke being at least 15 mm.

14. A method according to claim 9 wherein the bed includes a screen with apertures sized to pass at least 90% of dense particulates.

15. A method according to claim 9 wherein the bed includes a layer of aggregate having an average depth in excess of 50 mm.

* * * * *